United States Patent [19]

Burnett

[11] Patent Number: 4,592,579

[45] Date of Patent: Jun. 3, 1986

[54] SHIPPING CONTAINER SEAL

[76] Inventor: Ralph G. Burnett, 7314 - 3rd Ave., Kenosha, Wis. 53140

[21] Appl. No.: 477,772

[22] Filed: Mar. 22, 1983

[51] Int. Cl.[4] ..... G09F 3/00

[52] U.S. Cl. ..... 292/327; 24/114.5; 292/324

[58] Field of Search ..... 292/307, 327, 318–322, 292/324; 24/114.5, 573, 574, 90 R, 16 PB, 50 FP, 662; 339/205, 206, 103 C, 103 R; 411/64, 65, 67, 68, 455, 432, 433, 517, 519, 55, 508–510; 70/50, 54, 55, 56

[56] References Cited

U.S. PATENT DOCUMENTS

| | | | |
|---|---|---|---|
| 505,479 | 9/1893 | Platt | 24/90 R |
| 766,890 | 8/1904 | Newberg | 411/433 X |
| 932,159 | 8/1909 | Miller | 292/318 |
| 1,429,299 | 9/1922 | Pleister | 411/65 |
| 1,800,968 | 4/1931 | Tomkinson | 411/65 |
| 2,259,269 | 10/1941 | Ruth | 411/68 |
| 2,294,745 | 9/1942 | Goetz | 411/433 X |
| 2,685,211 | 8/1954 | Barrett | 411/55 |
| 3,265,426 | 8/1966 | Brooks et al. | 292/307 R X |
| 3,666,016 | 5/1972 | Estes | 292/307 R X |
| 3,751,948 | 8/1973 | Klein | 70/55 |
| 3,892,013 | 7/1975 | Gould | 24/90 R X |
| 3,975,040 | 8/1976 | Van Gompel | 292/318 |
| 4,033,155 | 7/1977 | De Lucia | 70/56 |
| 4,238,941 | 12/1980 | Halopoff | 70/56 |
| 4,402,639 | 9/1983 | Kessler | 411/65 X |

FOREIGN PATENT DOCUMENTS

| | | | |
|---|---|---|---|
| 968198 | 5/1975 | Canada | 411/433 |
| 1429628 | 5/1969 | Fed. Rep. of Germany | 411/433 |
| 912009 | 4/1946 | France | 411/433 |

*Primary Examiner*—Robert L. Wolfe
*Assistant Examiner*—Russell W. Illich
*Attorney, Agent, or Firm*—Allegretti, Newitt, Witcoff & McAndrews, Ltd.

[57] ABSTRACT

A shipping container seal for joining two members having holes therein. The seal comprises a male member adapted to pass through the holes in one direction having an enlargement at one end to preclude the male member from slipping entirely through the hole. A female member cooperates with the male member to prevent retrograde motion. Once the male member and the female member are assembled, the female member has locking means cooperating with the male member to permit it to pass through the female member in one direction but precluding retrograde motion. The female member may comprise a plurality of inwardly extending projections or a plurality of half-barrel shaped inserts with spring means for retaining the half-barrel inserts in assembled relationship. A feature of the latter construction is the configuration of the spring means which includes a clip having first and second sections complementary to the half-barrel shaped inserts and a bridge including a roof portion which will expand and contract connecting the first and second sections. A further feature of the invention is the provision of a hood comprising a tubular housing for enclosing the male member and female member so as to prevent access thereto after the hood is assembled.

4 Claims, 38 Drawing Figures

SHIPPING CONTAINER SEAL

BACKGROUND OF THE INVENTION

This invention relates to a seal mechanism and more particularly to a seal mechanism for securely fastening the doors of a maritime shipping container.

Maritime shipping containers for containerized shipping have been increasingly popular for the shipping of products and materials overseas. A maritime shipping container is essentially the same as a semi-trailer, but without wheels. The doors of the container, which allow access to the interior of the container, are essentially the same as the doors of a semi-trailer.

Brackets are provided on the doors of the maritime shipping containers for receiving sealing devices to seal the container against unauthorized entry. Theft of the contents is a problem with maritime shipping containers, which often sit unprotected in isolated areas.

A known sealing mechanism comprises a male member which is adapted to be inserted through aligned openings in the brackets into a female member which is secured to the male member. Such sealing mechanism is relatively expensive to manufacture for it basically consists of five parts which must be separately made, machined, and assembled. The female member particularly requires considerable machining.

Another disadvantage of the prior sealing mechanism is that it can be simply altered so as to allow insider theft by employees. For example, the tip of the male member could be ground or otherwise machined to remove a small amount of material and then the tip could be polished to conceal the alteration. The prior art sealing mechanism could then be assembled in its intended manner, but a vigorous tug on the female member relative to the male member would cause the male member to slip out.

A further disadvantage of the prior art sealing mechanism is that it cannot easily accommodate misalignment of the brackets. If a door sags, for example, the holes in the brackets which receive the sealing mechanism become misaligned. The cylindrical sealing member cannot be inserted through greatly misaligned holes in the brackets to seal the doors of the container and could be inserted through slightly misaligned or offset holes only with difficulty.

An object of the present invention is to provide an improved sealing mechanism wherein the disadvantages and deficiencies of prior sealing mechanisms are obviated.

Another object of the present invention is to provide an improved sealing mechanism which includes a curved male member formed from segment defining tooth means on the exterior thereof, said male member cooperating with a complementary curved female member having an insert for receiving the male member and preventing retrograde motion of the male member relative to the female member after insertion therein.

Other objects and advantages of the present invention will be made more apparent hereafter.

BRIEF DESCRIPTION OF THE DRAWING

There is shown in the attached drawing presently preferred embodiments of the present invention, wherein like numerals in the various views refer to like elements and wherein.

DESCRIPTION OF THE PRIOR ART

Figure 1:
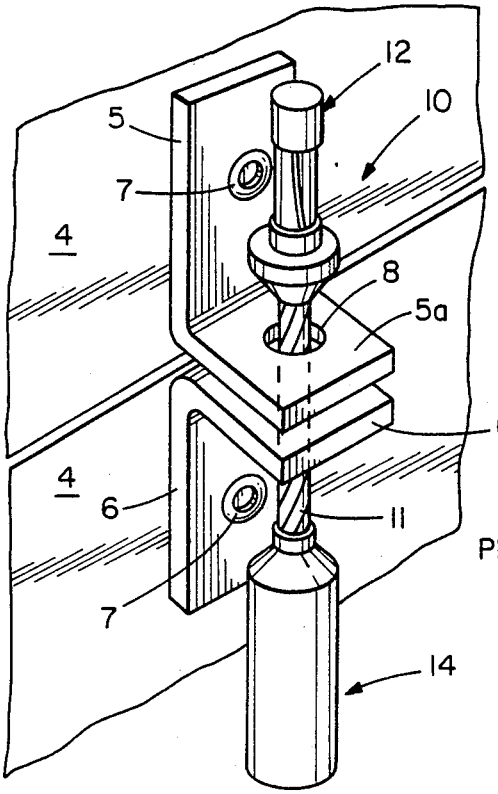
FIG. 1 PRIOR ART
FIG. 1 is a perspective view of a prior art seal mechanism shown in use in the brackets of the door of a shipping container.
Figure 2:
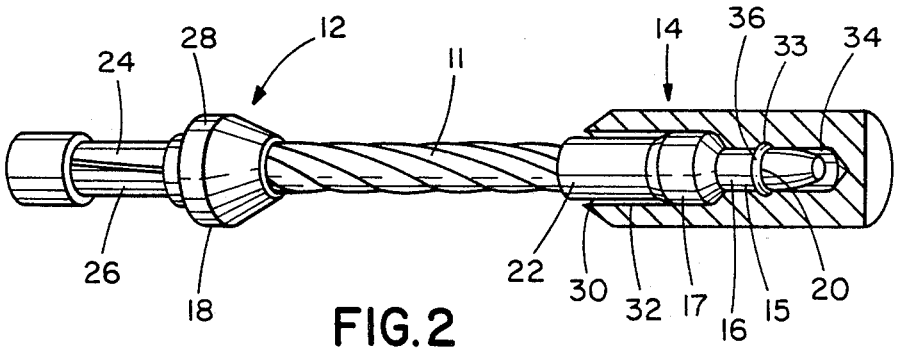
FIG. 2 PRIOR ART
FIG. 2 is a perspective view of the prior art seal mechanism of FIG. 1, with the female part being broken away to better show the assembled relationship of components.

Referring to FIGS. 1 and 2, there is shown a prior art sealing device 10 for sealing the doors 4 of a maritime shipping container. The doors 4 are closed and secured by handle means (not shown). Attachment means comprising brackets 5 and 6 are attached to the doors 4 by rivets 7. The brackets 5 and 6 may be right angles as shown and each is adapted to swivel or rotate about its rivet 7.

In most cases, either or both of brackets 5 and 6 are rotated about rivets 7 so as to allow the handle of the doors (not shown) to be placed into the space between the parallel parts 5*a* and 6*a* of the brackets and then brackets 5, 6 are rotated back to the positions shown in FIG. 1 to entrap the handle. If desired, the right angled bracket 5 may be incorporated into the handle as an integral part thereof.

There is a hole 8 in each bracket 5, 6. When sealing the doors 4, the brackets 5, 6 are positioned to align the holes 8 and a sealing mechanism 10 is inserted through the holes 8 and locked so as to prohibit unauthorized opening of the doors 4 of the containers. In one practical form of brackets, the holes 8 are about ½ inch in diameter.

The sealing mechanism 10 comprises basically a male member 12 and a female member 14.

The male member 12 includes a nose section 16, a central portion of twisted wire rope 11 and a terminal section 18. The bullet-shaped nose portion 16 is forcibly crimped onto an end of the wire rope 11. Such nose portion 16 is usually fabricated from metal, such as brass. A wide terminal metal section 18 is forcibly crimped onto the opposite end of the wire rope 11.

The bullet-shaped nose section or portion 16, near its rear, contains a circumference groove 20. This circumference groove 20 is of smaller diameter than, and is thus depressed below, the surface of the portion 15 of the bullet-shaped nose 16, which portion 15 is distal to the groove 20. The groove 20 is also of smaller diameter than, and is thus depressed below the nose portion 16, which nose portion 16 is proximate to the groove 20.

The bullet-shaped nose 16 also has a portion 17 of wider diameter. The bullet-shaped nose 16 is forcibly crimped, at its portion 22, onto the end of the wire rope 11. The portion 22 of the nose 16 is hollow for receiving the end of wire rope 11.

The central wire rope section 11 is flexible. In one known form it consists of twisted wire rope of about ¼ inch diameter.

At the back end of the male member 12, terminal part 24 is hollow. The hollow terminal part 24 is crimped onto the end of the wire rope 11 in its central section 26. The portion 28 of the terminal part 24 is enlarged so that its diameter is substantially greater than the diameter of the holes in the right-angled brackets on the doors of the maritime shipping container.

The female receptacle 14 consists of a section of round metal rod about ¾ inch diameter in one known device. At its open end 30, it is cone-shaped. The female receptacle 14 is drilled and reamed to form two hollow chambers. Closest to its open end a wider cylindrical chamber 32 is formed; in its deeper portion a narrower cylindrical chamber 34 is formed. A third cylindrical chamber 33 is then formed in the wall of chamber 34; the cylindrical chamber 33 is of approximately equal diameter to chamber 32, but of wider diameter than chamber 34. A round ring 36 is placed into chamber 32 and then the round ring 36 is forced into chamber 34 and propelled along chamber 34 until it drops into chamber 33 where it expands and become permanently lodged. The round ring 36 has an outside diameter approximately equal to the diameters of chambers 32 and 34.

The prior art seal mechanism 10 is assembled as follows. First, the male member 12 is dropped or forced through the holes 8 in the brackets 5 and 6 on the door of the maritime shipping container. Then the female receptacle or member 14 is placed over the bullet-shaped nose portion 16 of the male member 12 and is forced manually upward over the bullet-shaped nose portion 16 of the male member 12. The tip portion 15 of the bullet-shaped nose portion 16 gradually dilates the round ring 36 until the roung ring 36 lodges itself into the groove 20. The round ring 36 is entrapped in chamber 34 and in turn entraps the male member 12 by lodging in groove 20.

One disadvantage of the sealing mechanism 10 is that it is relatively expensive to manufacture. It consists of five parts, each of which must be separately formed and then assembled. Moreover, the female receptacle 14 requires substantial machining. Chambers 32 and 33 must be separately drilled and reamed. Chamber 33 must then be formed by a recessing tool which is operated in a drill press. Finally, the round ring 36 must be forced into chamber 33.

Another disadvantage of sealing mechanism 10 is that it can be simply altered so as to allow insider theft by employees. A thief would only need to remove about 0.001 inch from the diameter of the tip 15 of the bullet-shaped nose portion 16 of the male member 12. This could be easily done on a grinding wheel and the tip then repolished so as to conceal the alteration. The seal mechanism 10 could then be assembled in the customary way and it would stay in place. However, a vigorous tug on the female receptacle 14 at a future time would cause the tip 15 of the male member 12 to slip out of the round ring 36 and the doors of the container could be opened.

The sealing mechanism 10 is not readily adaptable to misalignment of the holes in brackets 5, 6. If holes 8 are not aligned, the available space in the round holes 8 becomes an ellipse. The more the holes 8 are misaligned, the smaller the ellipse becomes and the more difficult it is to insert the sealing mechanism 10. The bullet shaped nose section 16, being rigid, could not pass through the two holes in the closely spaced right angled brackets if the holes were badly misaligned.

DETAILED DESCRIPTION OF THE INVENTION

Figure 3:
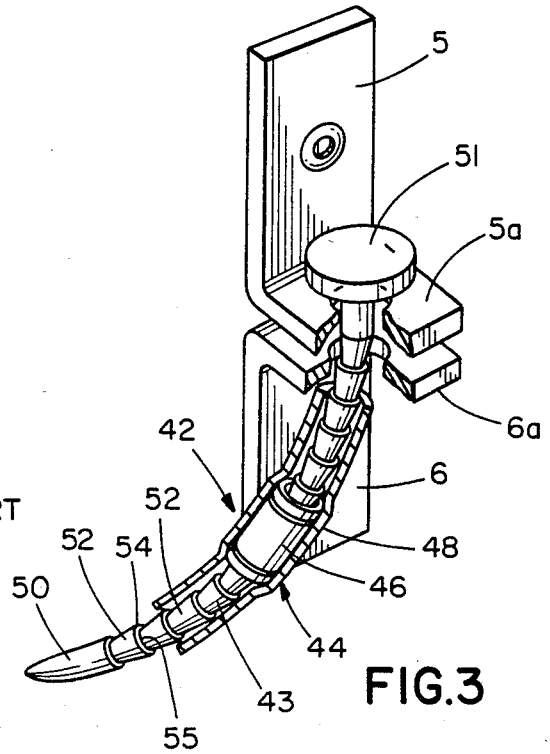
FIG. 3 is a perspective view similar to FIG. 1 illustrating a seal mechanism embodying the present invention.

A first embodiment of the present invention is shown in FIGS. 3–8. The seal mechanism 42 comprises a male member 43, and a female receptacle 44 comprising an insert 46 fabricated from spring steel and an outer capsule 48. FIG. 3 illustrates the assembled seal mechanism 42 in its use position, with the male member 43 and female receptacle 44 assembled in the brackets 5, 6 of a maritime shipping container.

The male member 43 (best shown in FIGS. 3 and 4) comprises a cylindrical metal shaft approximately $4\frac{1}{2}$ inches long in one present embodiment. The widest diameter of the metal shaft of male member 43 is about $\frac{1}{4}$ inch. The cylindrical metal shaft is curved along its longitudinal axis through a curve whose radius is about 3.125 inches.

The cylindrical metal shaft of male member 43 is provided at its front end with a blunt pointed tip 50. The back end the cylindrical metal shaft terminates in a cylindrical enlargement 51, which is larger than the holes 8 in the door brackets 5, 6 of the shipping container, and functions as a stop to prevent the male member 43 from slipping entirely through the holes 8.

The metal shaft of male member 43 is formed from a plurality of segments 52 shaped like truncated cones. The widest diameter 54 of each segment 52 is closest to the back end of the male member 43. The narrowest diameter 55 of each segment 52 is closest to the tip 50 of the male member 43.

The female receptacle 44 (best shown in FIGS. 3, 5 and 6) comprises the insert 46, which may be stamped from a blank of sheet metal, and an outer capsule 48. The outer capsule 48 is a curved metal cylinder with strong relatively thick walls 56. The central longitudinal axis of the outer capsule 48 has a radius the same as that of the male member 43, which in the described form of the invention is about 3.125 inches.

The outer capsule 48 may be fabricated from standard metal tubing having a wall thickness of about 0.0625 inch and an inside diameter of $\frac{1}{2}$ (0.50) inch. The metal tubing is cut to length of about 2.375 inches. One end of the metal tubing for the outer capsule 48 is placed into a swaging machine and its diameter is reduced, as shown for example at 62 in FIGS. 5 and 6. The metal tubing is placed into a fixture and bent into a curve having a radius of about 3.125 inches. Two round rings 63 and the spring steel insert 46 are then inserted through the wide open end 66 of the metal tubing (FIG. 6) into chamber 61. It is noted that swaging the portion 62 resulted in the formation of a short, cone-shaped segment 64 in the metal tubing of the outer capsule 48. This cone-shaped segment 64 could cause a wedging force to be applied to the ends 65 of the spring steel insert 46 during assembly of the seal mechanism. To prevent this wedging force on the ends 65 of the spring steel insert 46, two round rings 63 are provided, one on each side of the insert 46. These rings 63 will provide a rigid, abrupt stop for the insert 46. The round rings 63 must have the least wall thickness that will allow them to afford an abrupt stop for the insert 46, yet the rings 63 must not have a wall thickness which would interfere with the deflection of the wedge-shaped inward projections 72 of the insert 46.

Figure 5:
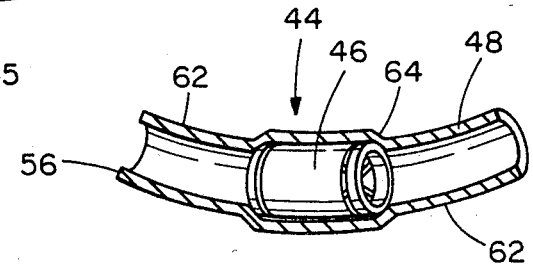
FIG. 5 is a perspective view of the female member of the seal mechanism of FIG. 3.
Figure 6:
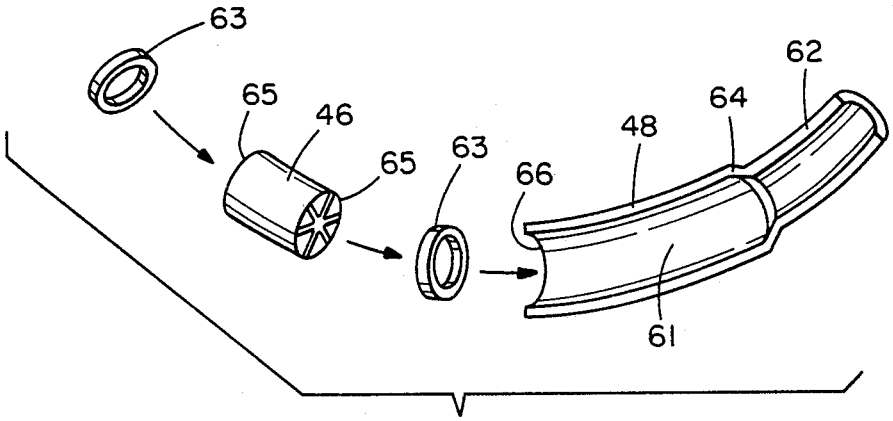
FIG. 6 is an exploded view illustrating the assembly of the female member.

Next, the wide open end 66 of the metal tubing (FIG. 6) is placed into a swaging machine to reduce the diameter of the end 66 to the diameter of the end 62 (FIG. 5). After swaging the end 66 will be straight. The mated tubing is placed into a second fixture so as to bend the end 66 along a curve having a radius of 3.125 inches. The two round rings 63 and insert 46 are enclosed within the central chamber of the outer capsule 48.

The construction and function of the insert 46 will now be described more fully. Insert 46 may be formed from a spring steel blank (FIG. 7) comprising a central body 70 and a multiplicity of wedge-shaped projections 72 alongs its sides. Each wedge-shaped projection 72 ends in a curved termination 74. Each curved termination has the same radius as the narrowest diameter 55 of each segment 52 of the body of the male member 43.

Figure 7:
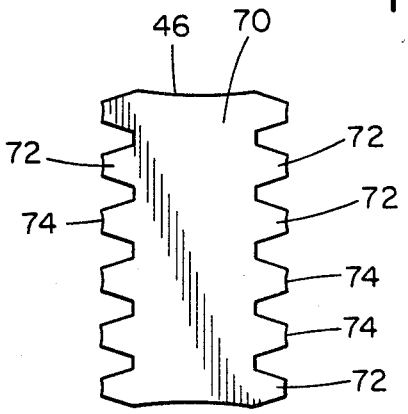
FIG. 7 is a plan view of the blank for forming the insert for the female member of the seal mechanism of FIG. 3.
Figure 7A:
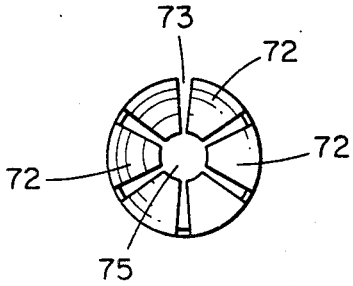
FIG. 7A is an enlarged end view of the insert of the female member shown in FIG. 5.

After the blank for insert 46 has been formed, for example, by stamping, the wedge-shaped projections 72 are each bent at their bases so that they lie in a right angle relative to the plane of the body 70 of the blank. The blank is then rolled into a cylinder wherein the wedge-shaped projections are inwardly deflected (FIG. 7A). Because the material for the insert is preferably spring steel, overbending of the wedge-shaped projections 72 will be necessary in order to achieve the ultimate desired right angle positioning of the projections 72 relative to the body 70. Because the material of the body 70 is spring steel, the blank will not remain cylindrical after it has been rolled; it will tend to open and form a gap 73 along the length of the rolled insert 46. This is acceptable, as will be described hereafter. Moreover, the blank must be rolled and formed into the shape of a slightly curved cylinder so that in its functioning configuration (FIG. 5) its longitudinal central axis has a radius of 3.125 inches and the gap 73 has a longitudinal axis lying in a curve having a radius of 2.90625 inches.

The insert 46 thus formed will be a slightly curved cylinder with twelve inwardly extending wedge-shaped projections 72. There will be six inwardly extending projections 72 along the two borders of each open end of the insert 46. When viewed from each end (for example, FIG. 7A), the wedge-shaped projections 72 form an open central irregular circle 75, which circle 75 has a diameter of 0.125 inch. This diameter of the open circle 75 is less than the narrowest diameter 55 of the segments 52 of the male member 43.

Figure 8:
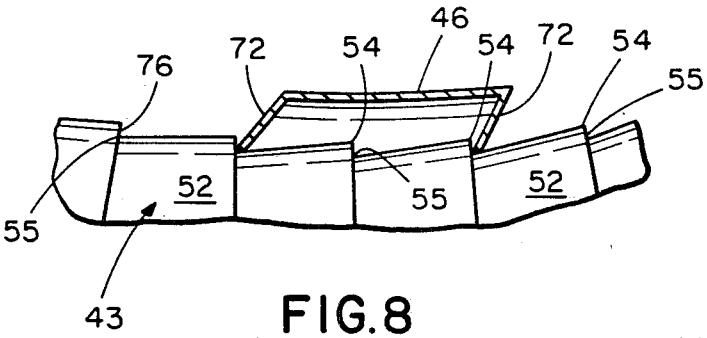
FIG. 8 is a detail view illustrating the cooperation between the inward projections on the insert of the female member and the exterior of the male member.

To assemble the male member 43 to the female member or receptacle 44, the female receptacle 44 is manually pushed over the male member 43 and toward the wide end flange 51 of the male member 43. The wedge-shaped projections 72 of the insert 46 are constantly displaced by this action as they move from the smallest diameter 55 of the segments 52 of the male member 43 to the widest diameter 54 of those segments 52. When the female receptacle 44 is then moved away from the wide end flange 51 of the male member 43, the wedge-shaped projections 72 will lodge themselves in the recess 76 of the next segment 52 of the male member 43 (FIG. 8). The projections 72 must be of sufficient length and properly constructed as shown and described to provide maximum resistance to retrograde motion once the seal mechanism is assembled. The seal mechanism must be destroyed in order to gain access to the contents of the maritime shipping container.

There is shown in FIGS. 9–17 an alternative seal mechanism 110. The seal mechanism 110 includes a male member 43 and a female receptacle 144. The male member 43 is the same as that previously described in the embodiment of FIGS. 3–8. The female receptacle 144 comprises two solid metal half barrel-shaped inserts 145, 146, a spring steel clip 147 and an outer capsule 148. The half barrel-shaped inserts 145, 146 are identical. They may be manufactured by suitable known fabrication methods, for example, metal stamping or die casting. Each is slightly curved along its longitudinal axis. In one present form of the invention, the longitudinal axis of the inserts 145, 146 lies along a curve having a radius of 3.125 inches.

Figure 4:
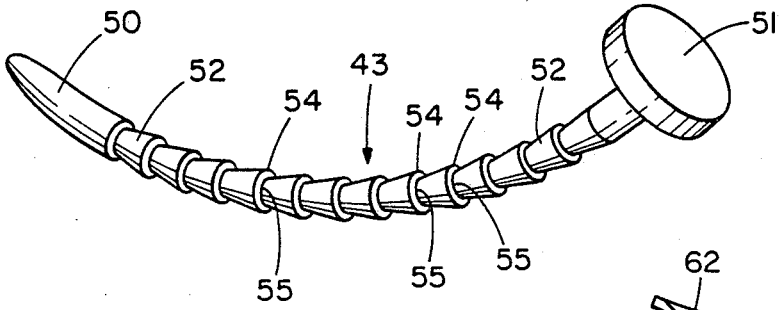
FIG. 4 is a perspective view of the male member of the seal mechanism of FIG. 3.

The flat inside surface of the half-barrel-shaped insert 145 contains a recessed cavity 171. The wall of the recessed cavity 171 has the shape of two partial sections of two cones whose bases are in approximation in the center of the insert and whose narrow-most ends are at opposite extremes from each other. The center 172 of the wall of the recessed cavity 171 has a radius of 0.125 inch in one form of the invention, which radius is the same radius as the widest radius 54 of each cone shaped segment 52 of the male member 43 (FIG. 4). The ends 173 of the recessed cavity 171 have a radius of 0.09375 inch, which radius is the same as the radius of the narrowest radius 55 of each cone-shaped segment 52 of the male member 43. Thus, the recessed cavity 171 has the shape of two segments of two cones, which segments have their bases in approximation to each other in the center of ther recess 171 and the narrowest radii of the cones at the outer edges of the recessed cavity 171.

Figure 11:
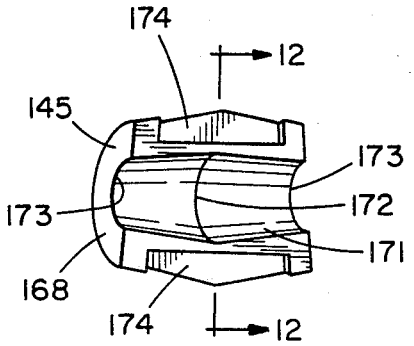
FIG. 11 is a perspective view of a part of the insert of FIG. 10.
Figure 12:
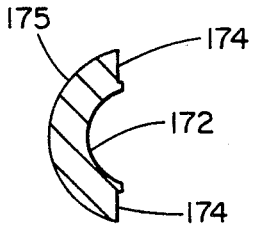
FIG. 12 is a cross-sectional view through the insert taken generally along the line 12—12 of FIG. 11.

More particularly, the half-barrel-shaped inserts 145, through generally shaped as half-barrels, are approximately 160 degree segments of a barrel shape (FIG. 12). The flat inside surface of the half-barrel-shaped insert 145 also has two shallow recessed areas 174 (FIGS. 11 and 12).

The outer surface of the solid metal half-barrel-shaped insert 145 (FIG. 10) is convex. Its central transverse diameter 175 is greater than the diameters of its ends 176.

The shallow recessed areas 174 of the flat inside surface of the half-barrel-shaped insert 145 are both continued into a shallow recessed area 177 on the outer surface. (FIGS. 10 and 12).

Figure 10:
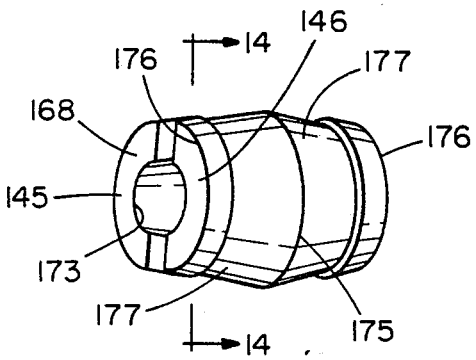
FIG. 10 is a perspective view of the modified insert for the modified seal mechanism of FIG. 9.
Figure 14:
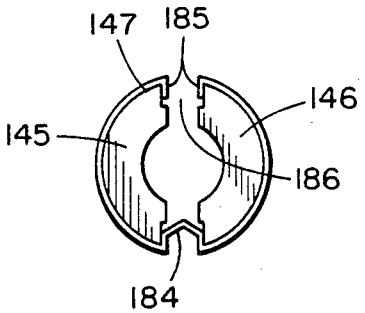
FIG. 14 is a cross-sectional view of the insert taken generally along line 14—14 of FIG. 10.
Figure 15:
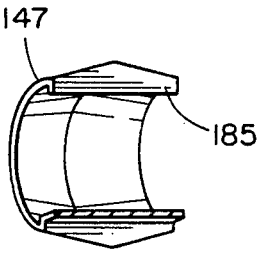
FIG. 15 is a perspective sectioned view of the spring clip of FIG. 13.

As shown in FIG. 10 and FIG. 14, the two solid metal half-barrel-shaped inserts 145 will be held in position by a spring steel clip 147.

Figure 13:
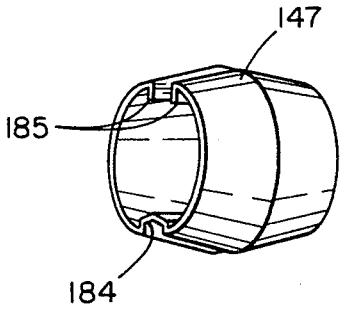
FIG. 13 is a perspective view of the spring clip of the female member of the seal mechanism of FIG. 9.
Figure 16:
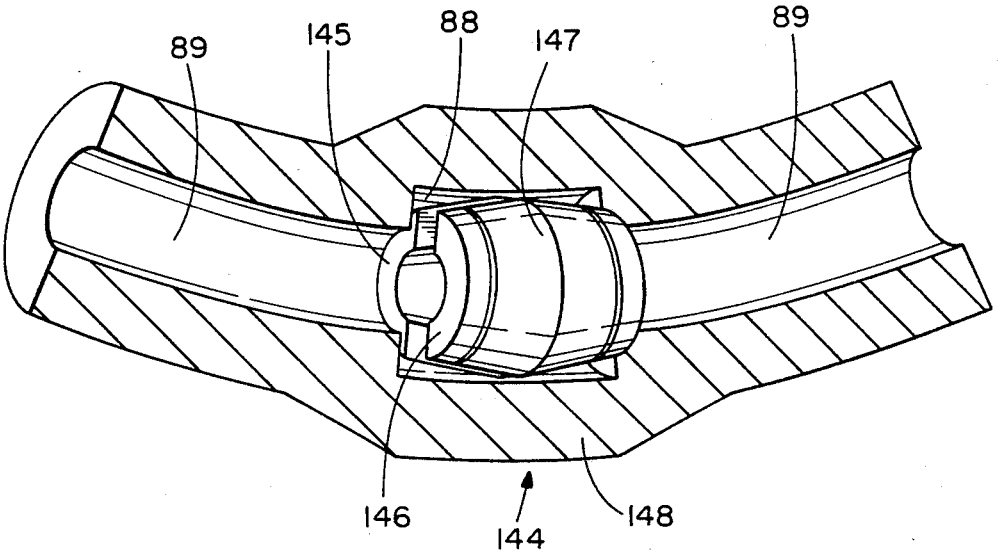
FIG. 16 is an enlarged perspective view of the female member of the seal mechanism of FIG. 9.

Referring to FIG. 13, there is shown the one piece spring steel clip 147. If it were divided in half, each half or side would have the same shape and dimensions as the shallow recessed area 177 on the outer surface of the half-barrel-shaped insert 145. Both halves of the spring steel clip 147 are connected or united by a bridge 184. As seen in FIG. 16 and FIG. 14, the two parallel sections of the bridge 184 have the same shape and dimensions as the shallow recessed area 174 on the flat inside surface of the solid metal half-barrel-shaped insert 145. The roof of the bridge 184 will expand and contract and thus will allow movement for the sides of the spring steel clip 147.

At the side opposite the bridge 184, the spring steel clip 147 has two inwardly deflected projections 185. Each inwardly deflected projection 185 has the same shape and dimensions as the shallow recessed area 174 on the flat inside surface of the solid metal half-barrel-shaped insert 145. The two inwardly deflected projections 185 are not connected by a bridge and, therefore, a gap 186 exists between them. This gap 186 will also allow movement for the sides of the spring steel clip 147.

Referring to FIGS. 10 and 14, the two solid metal half-barrel-shaped inserts 145, 146 have been assembled into and are being held in position by the spring steel clip 147. The spring steel clip 147 maintains a constant gap 186 between the half-barrel-shaped inserts 145, 146. The gap 186 is such that the ends 173 of the recessed cavity 171 of the inside surfaces of the two half-barrel-shaped inserts 145 are closer together than the narrowest diameter 54 of each cone-shaped segment 52 of the male member 43.

The female receptacle also has an outer capsule 148 (FIG. 16). It is similar to the outer capsule of the female receptacle 48. However, it contains only three chambers: a central wide chamber 88 and two outermost narrower chambers 89. Each narrower chamber 89 has a diameter slightly greater than the greatest transverse diameter of the body of the male member 43. The entire outer capsule 148 is curved and has a central longitudinal long axis of 3.125 inch radius. The two solid metal half-barrel-shaped inserts 145, 146 are enclosed by the spring steel clip 147 and lie within the central chamber 88 of the outercapsule 148.

Figure 17A:
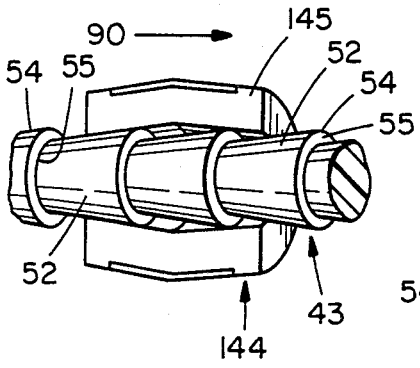
FIGS. 17A, 17B and 17C are perspective views illustrating sequentially how the male member and female member of the modified seal mechanism of FIG. 9 are interengaged.
Figure 17B:
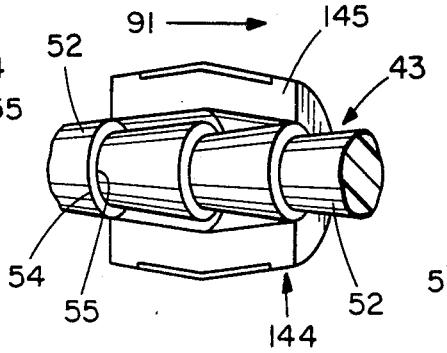
Figure 17C:
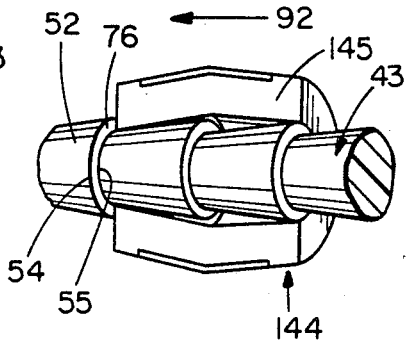

FIGS. 17A, 17B and 17C illustrate the rocking motion of the female receptacle comprised of the two half-barrel-shaped inserts 145, 146 as it is manually moved over the segments 52 of the male member 43. It should be obvious that the solid metal half-barrel-shaped inserts 145, 146 are identical parts; when a second part is placed in a mirror image position with the first part, both will have a position in which their central longitudinal long axes will be parallel.

Figure 9:
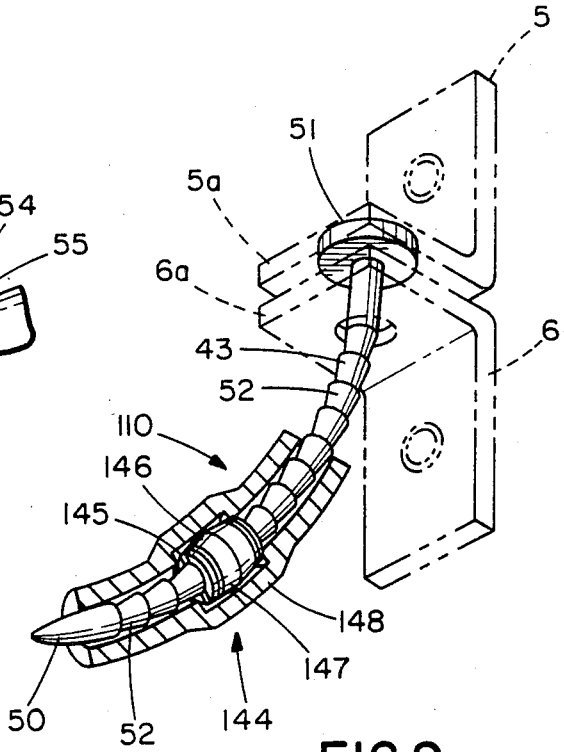
FIG. 9 is a perspective view similar to FIG. 3, illustrating a modified seal mechanism embodying principles of the present invention.

FIG. 9 illustrates a completely assembled modified container seal for a maritime shipping container. The male member 43 has been inserted through the holes 8 in the right angle door brackets 5 and 6 of the doors of the shipping container. A female receptacle 144 has been manually inserted onto the male member 43 although it has not been pushed onto the male member as far as it will go (for the purposes of illustration). The two solid metal half-barrel-shaped inserts 145, 146 are being compressed inwardly toward each other by the spring steel clip 147. This compressing force of the spring steel clip 147 allows the two solid metal half-barrel-shaped inserts 145, 146 (and the outercapsule which encloses them) to be pushed over the cone-shaped segments 52 of the male member 43 until the right angle bracket 6 prohibits any further travel. Moreover, the inward compressing force delivered by the spring steel clip 147 will cause the edges of the two half-barrel-shaped inserts 145, 146 to become trapped in a recess 76 of a cone-shaped segment 52 of the male member 43 when a backward force is applied to the female receptacle. This will prohibit disassembly of the seal.

FIGS. 17A, 17B and 17C further illustrate the inward compressing force of the spring steel clip 147. The outer capsule 148 has been omitted for the purpose of clarity.

The arrow 90 above FIG. 17A and the arrow 91 above FIG. 17B indicate that the female receptacle 144 is being manually pushed from left to right over the sequential cone-shaped segments 52 of the male member 43. As the half-barrel-shaped inserts 145, 146 and the spring steel clip 147 which holds them tightly compressed against the male member 43 are propelled from left to right there is produced a rocking motion to the two half-barrel-shaped inserts 145, 146.

The arrow 92 above FIG. 17C indicates a backward force is being applied in an attempt to disassemble the container seal. This backward force 92, by virtue of the compression delivered by the spring steel clip 147 to the half-barrel-shaped inserts 145, 146, will cause an edge of the two half-barrel-shaped inserts 145, 146 to be trapped in a recess 76 of a cone-shaped segment 52 of the male member 43.

The outer capsule 148 for the female receptacle 144 can easily be made from metal tubing by swaging just as was shown in the preferred embodiment of FIGS. 3 through 8. Only dimensions would need to be changed.

With reference to FIGS. 18–22, there is shown a further modification of the present invention. The seal assembly 210 comprises a male member 43 which is exactly the same as the male member 43 in the prior embodiments of the invention and a female receptacle 244 which comprises two solid metal partial-cone-shaped inserts 292, a cone-shaped spring steel clip 293, and an outer capsule 294. Each solid metal partial-cone-shaped insert 292 is a 160 degree segment of a cone.

The flat inside surface (FIG. 19) of the solid metal partial-cone-shaped inserts 292 each contains two recessed cavities 298. The two recessed cavities 298 are identical to each other. Each recessed cavity 298 has the shape of a partial cone. The widest radius 299 of each partial-cone-shaped cavity 298 is closest to the narrowest terminal end of the solid metal partial-cone-shaped insert 292. The narrowest radius 300 of each partial-cone-shaped cavity 298 is closest to the widest terminal end of the solid metal partial-cone-shaped insert 292. Each partial-cone-shaped cavity 298 has the same shape and dimensions as each cone-shaped segment 52 of the male member 43.

The inside surface (FIG. 19) of the solid metal partial-cone-shaped insert 92 also has two shallow recessed areas 301.

Figure 20:
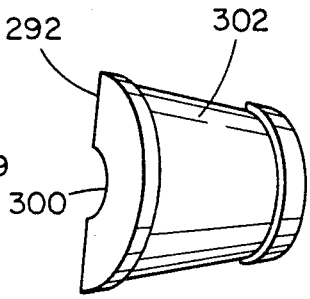
FIG. 20 is a perspective view of a part of the partial cone-shaped insert of the seal mechanism of FIG. 18 showing the exterior thereof.

The two shallow recessed areas 301 are both continued into a shallow recessed area 302 on the outer surface of the solid metal partial-cone-shaped insert 292 (FIG. 20).

Figure 21:
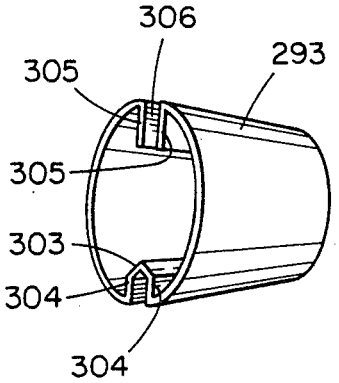
FIG. 21 is a perspective view of the spring clip for the partial cone-shaped insert of FIG. 18.

The two solid metal partial-cone-shaped inserts 292 are held in position by a spring steel clip 293, which spring steel clip is conically shaped (FIG. 21). The spring steel clip 293 is one piece. If the spring steel clip 293 were divided in half, each half would have the same shape and dimensions as the shallow recessed area 302 on the outer convex surface of the partial-cone-shaped insert 292. Both halves of the spring steel clip 293 are united by a bridge 303. The two parallel sections 304 of the bridge 303 have the same shape and dimensions as the shallow recessed area 301 on the flat inside surface of the partial-cone-shaped insert 292. The roof of the bridge 303 will expand and contract and thus will allow movement for the sides of the spring steel clip 293.

At the side opposite the bridge 303, the spring steel clip 293 has two inwardly deflected projections 305. Each inwardly deflected projection 305 has the same shape and dimensions as the shallow recessed area 301 of the partial-cone-shaped insert 292. The two inwardly deflected projections 305 are not connected by a bridge and, therefore, a gap 306 exists between them. gap 306 will also allow movement for the sides of the spring steel clip 293.

The two solid metal partial-cone-shaped inserts 292 are assembled one into each half of the spring steel clip 293. The spring steel clip 293 holds the two solid metal partial-cone-shaped inserts 292 so that the diameter formed by the narrowest radii 300 of the opposing recessed cavities 298 shall be less than the narrowest diameter 55 of each cone shaped segment 52 of the male member 43 and so that the widest radii of the opposing recessed cavities 298 shall be less than the widest diameter 54 of each cone shaped segment 52 of the male member 42.

Figure 22:
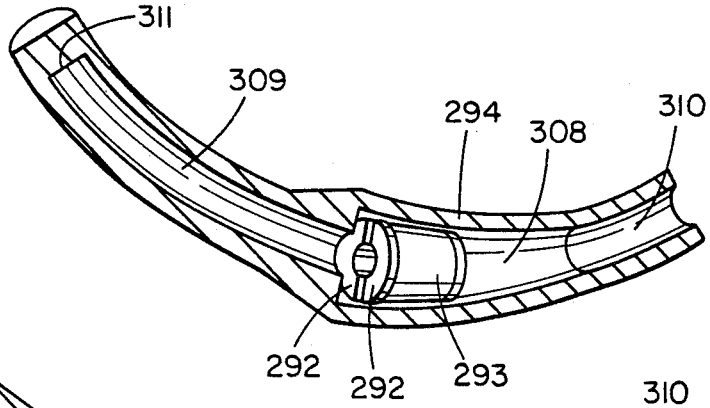
FIG. 22 is a perspective view of the female member of the modified seal mechanism of FIG. 18.

The female receptacle has an outer capsule 294 (FIG. 22). The outer capsule 294 contains three chambers: a central curved conical chamber 308; a narrow curved chamber 309, which opens into the wide end of the central conical chamber 308; and a narrow curved chamber 310 which opens into the narrow end of the central conical chamber 308. The narrow curved chamber 309, which is the innermost chamber, ends in an enclosed termination 311. The narrow curved chamber 310, which is the outermost chamber, opens onto the surface of one end of the outer capsule 294. The entire outer capsule 294 and its three chambers have a central longitudinal long axis of 3.125 inches, in a present embodiment of the invention.

To assemble the female receptacle, one solid metal partial-cone-shaped insert 292 is placed in a mirror image position in relation to another partial-cone-shaped insert 292 and both are then inserted into the spring steel clip 293. These three assembled parts are then placed in the central conical chamber 308 of the outer capsule 294. The final completely assembled female receptacle is illustrated by FIG. 22.

Figure 18:
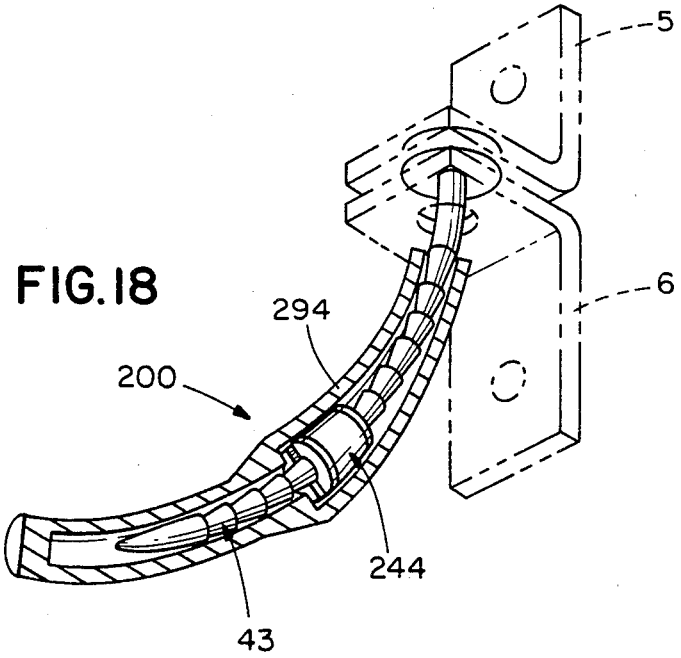
FIG. 18 is a perspective view similar to FIG. 3 illustrating another modified seal mechanism embodying principles of the present invention.
Figure 19:
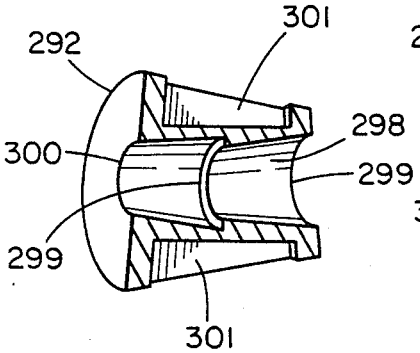
FIG. 19 is a perspective view of a part of the partial cone-shaped insert of the seal mechanism of FIG. 18 showing the interior thereof.

FIG. 18 illustrates an assembled container seal. The male member 43 has been inserted through the holes 8 in the right angle door brackets 5 and 6 of the doors of the shipping container. A female receptacle 244 has been manually inserted onto the male member 43, although it has not been pushed as far as it will go (for the purpose of illustration). The two solid metal partial-cone-shaped inserts 292 are being compressed inwardly by the cone shaped spring steel clip 293. This compressing force of the spring steel clip 293 allows the two partial-cone-shaped inserts 292 (and the outer capsule which encloses them) to be pushed over the cone-shaped segments 52 of the male member 43 until the right angle bracket 6 prohibits any further travel. The spring steel clip 293 will cause the edges of the solid metal partial-cone-shaped inserts 292 to become entrapped in a recess 76 of a cone-shaped segment 52 of the male member 43 when a backward force is applied to the female receptacle. Moreover, if the backward force applied to the female receptacle is continued, the wedge-shaped sides of the central conical cavity 308 of the outer capsule 294 will compress the sides of the spring steel clip 293 and the two solid metal partial-cone-shaped inserts 292. This wedge compression will ensure the continued entrapment of the edges of the two partial-cone-shaped inserts 292 by the recess 76 of a cone-shaped segment 52 of the male member 43. Disassembly of the container seal is thus prohibited.

Figure 23:
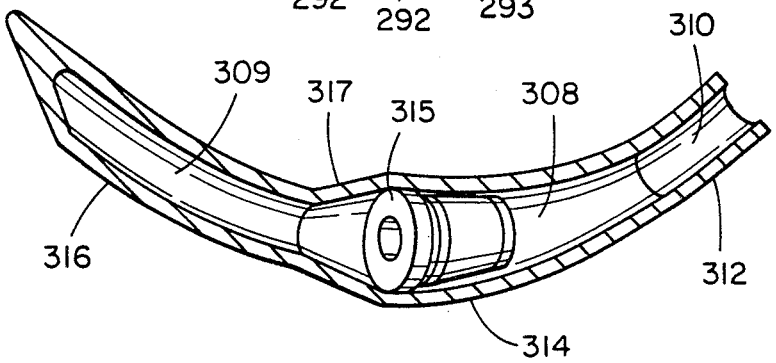
FIG. 23 is a perspective view similar to FIG. 22 illustrating a female member with an outer housing formed by swaging.
Figure 24:
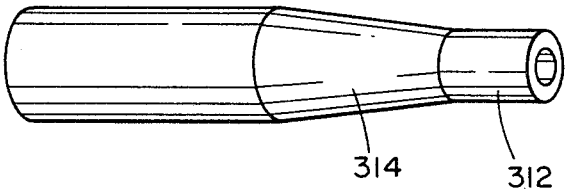
FIG. 24 is an elevation view of the outer housing of FIG. 23 at an early stage in manufacture.
Figure 25:
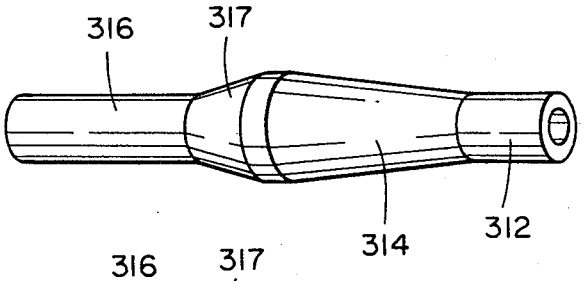
FIG. 25 is an elevation view of the outer housing of FIG. 23 at a later state in manufacture than is shown in FIG. 24.
Figure 26:
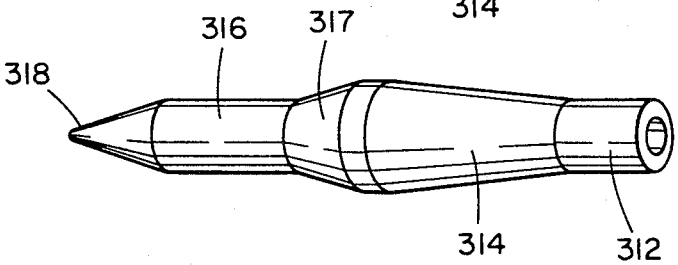
FIG. 26 is an elevation view of the outer housing of FIG. 23 at a later stage in manufacture than is shown in FIG. 25.
Figure 27:
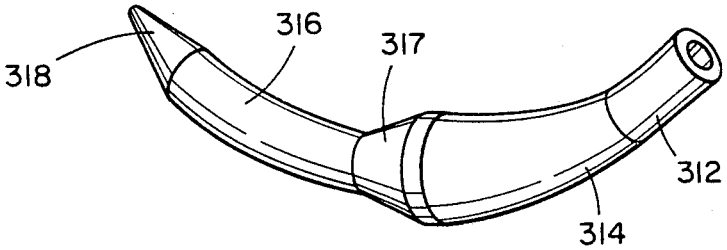
FIG. 27 is an elevation view of a completed outer housing as shown in FIG. 23.

The outer capsule 294 of the female receptacle can also be easily made from metal tubing by swaging. FIGS. 24 through 27 illustrate the steps in this swaging process and FIG. 23 is a cross sectional view of a completed receptacle, which uses metal tubing for the outer capsule. First, cut a section of metal tubing. Then, swage one end of the metal tubing so as to produce a cylindrical end section 312 of smaller diameter, which shall have an inside diameter slightly larger than the greatest outside diameter of the body of the male member 43 and a long conical section 314. Insert two solid metal partial-cone-shaped inserts 292 enclosed by a cone-shaped spring steel clip 293 into the wide open end of the metal tubing. Insert one round ring 315 which has an inside diameter larger than the widest outside diameter of the body of the male member 43. Now swage the wide end of the metal tubing so as to produce a cylindrical end section 316 of equal diameter to the opposite end section 312, and a short conical section 317. Swage the open end of the cylindrical end section 316 so as to close its opening completely. Place the straight female receptacle (as shown in FIG. 26) into a fixture and form it into a curve so that its central longitudinal long axis will have a radius of 3.125 inches (for one present embodiment of the invention) as shown in FIG. 27.

The one round ring 315 is needed in order to provide a sudden stop so that the short conical section 317 cannot exert a wedging force on the two solid metal partial-cone-shaped inserts 292. When the seal is being assembled, the tip of the male member 43 will push the two partial-cone-shaped inserts 292 (and their enclosing spring steel clip 293) from right to left. This could easily cause the short conical section 317 to exert a wedging force on the back ends of the two partial-cone-shaped inserts 292 and thus prohibit the assembly of the seal. The round ring 315 will provide a sudden stop and thus will prevent this undesirable wedging force by the short conical section 317.

The seal assembly of FIGS. 18 through 22 has an outer capsule one end of which is closed. It may be desirable to construct a female receptacle like the female receptacles of the prior embodiments, the other capsules of which have two open ends and where either open end of the outer capsule can be inserted over the tip of the male member 43.

The embodiment of FIGS. 28 through 31 uses exactly the same solid metal half-barrel-shaped inserts 145, 146 as in FIG. 9 and uses exactly the same spring steel clip 147 as in FIG. 13.

If one were to analyze FIGS. 9 through 16, it would be obvious that the solid metal half-barrel-shaped inserts 145, 146 do not need a half-barrel shape, i.e., the terminal ends of the half-barrel-shaped inserts 145, 146 do not need to be smaller than the center. However, the half-barrel-shaped inserts 145, 146 do need to be half-barrel shaped for the embodiment of FIGS. 28–31.

Figure 28:
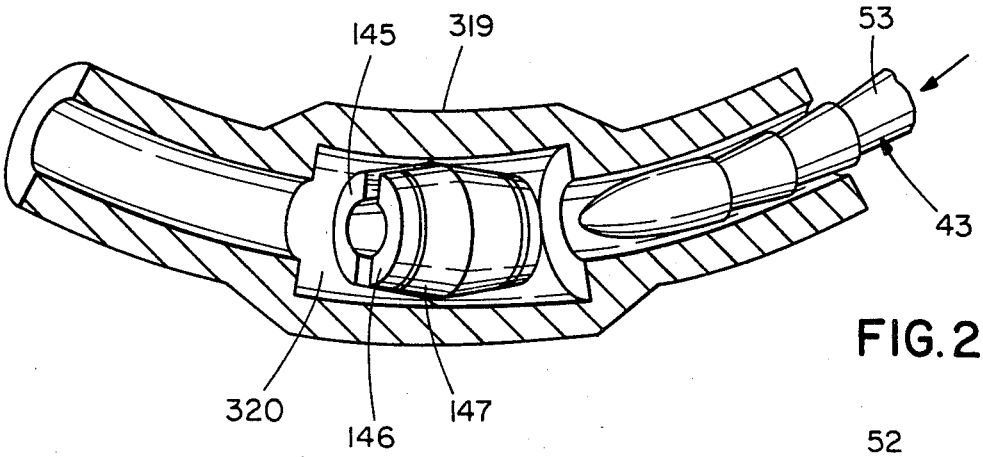
FIG. 28 is a perspective view partially in section of another female member similar to that of the embodiment of FIG. 9, wherein the chamber in the outer housing has an hourglass configuration, and showing the male member just prior to entry into the insert.
Figure 29:
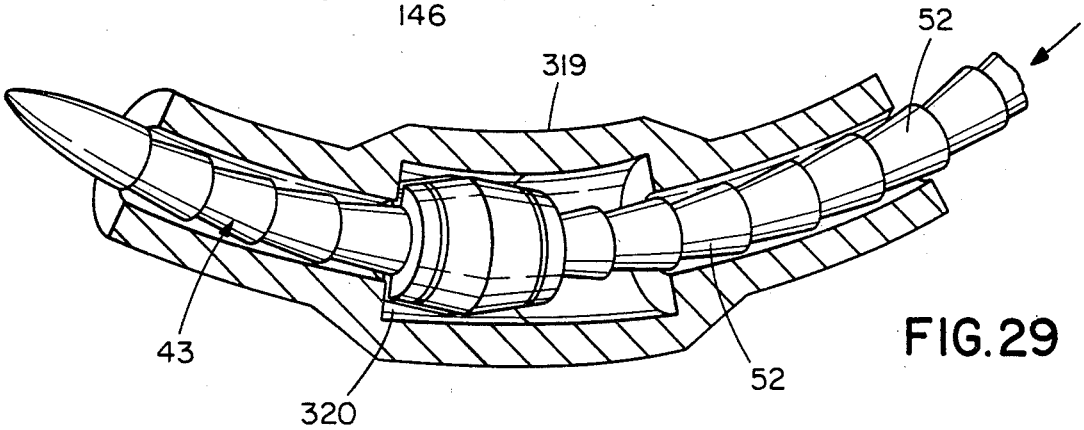
FIG. 29 is a perspective view of the embodiment of FIG. 28 illustrating the male member being inserted through the insert to assemble the components.
Figure 30:
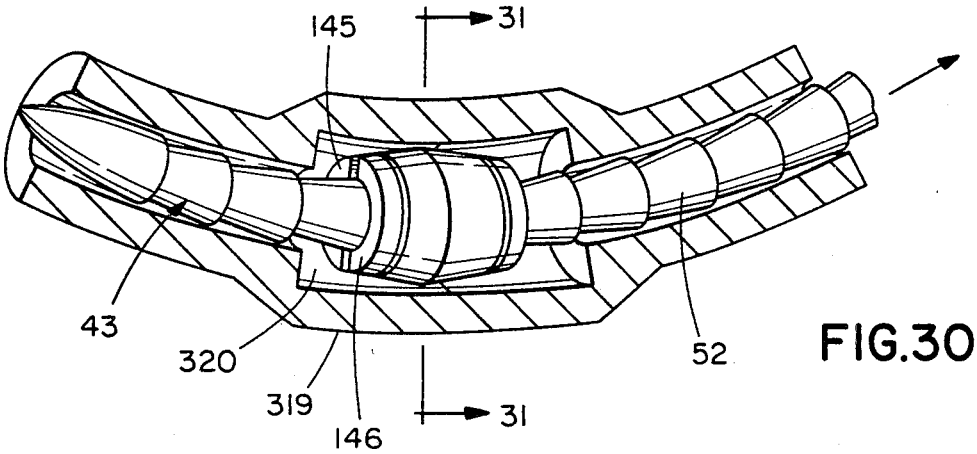
FIG. 30 is a perspective view of the embodiment of FIG. 28 illustrating the components assembled and located together.

FIGS. 28 through 30 disclose an outer capsule 319 which is very similar to the outer capsule 148 of FIGS. 9–16. However, the central cavity 320 of the outer capsule 319 has an hour glass configuration. The central cavity 320 is constricted at the plane 31—31, which plane 31—31 is the transverse transectional midplane of the central cavity 320. See FIG. 30.

As seen in FIG. 28, the arrow behind the male member 43 indicates that the male member 43 has been inserted into one of the open ends of the female receptacle and is being pushed toward the central cavity. The assembled two half-barrel-shaped inserts 145, 146 and their enclosing spring steel clip 147 lie within the central cavity 320.

As seen in FIG. 29, the male member 43 has pushed the two half-barrel-shaped inserts 145, 146 and the spring steel clip 147 through the central cavity 320 until the half-barrel-shaped inserts 145, 146 strike the end of the central cavity 320 and can go no further. The tip of the male member 43 thereafter forces the spring steel clip 147 to expand, which allows the cone-shaped segments 52 of the male member 43 to penetrate and transverse—one after another—the central cavity formed by the opposing inside surfaces of the two solid metal half-barrel-shaped inserts 145, 146.

As seen in FIG. 30, a backward force, when applied, will cause the sides of the spring steel clip 147 (with the half-barrel-shaped inserts 145, 146 beneath it) to strike and wedge against the sides of the central cavity 320. Because the edges of the half-barrel-shaped inserts 145, 146 have been entrapped by a recess 76 of a cone shaped segment 52 of the male member 43, the wedging force delivered by the sides of the central cavity 320 prohibits disassembly of the seal.

The spring steel clip 147 enclosing the two half-barrel-shaped inserts 145, 146 is free to move back and forth within the central cavity 320 in the female receptacle until the male member 43 forces the two half-barrel-shaped inserts 145, 146 away from each other. Once this has happened, the total transverse width of the male member 43, two surrounding half-barrel-shaped inserts 145, 146 and spring steel clip 147 is greater than the inside diameter of the transverse transectional midplane 31—31 of the central cavity 320. Thus, a wedging force is thereafter delivered by the walls of the cavity 320.

Figure 31:
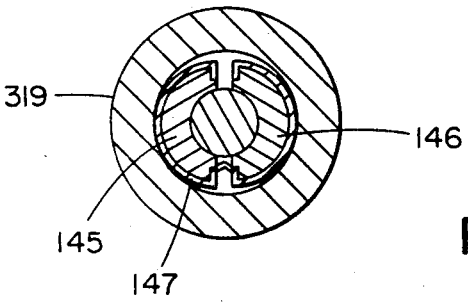
FIG. 31 is a cross-sectional view of the seal mechanism of FIG. 28 taken generally along line 31—31 of FIG. 30.

As shown in FIG. 31, the side walls of the central cavity 320 are too narrow for the widened half-barrel-shaped inserts 145, 146, spring steel clip 147 and male member 43 to pass backwards.

Figure 32:
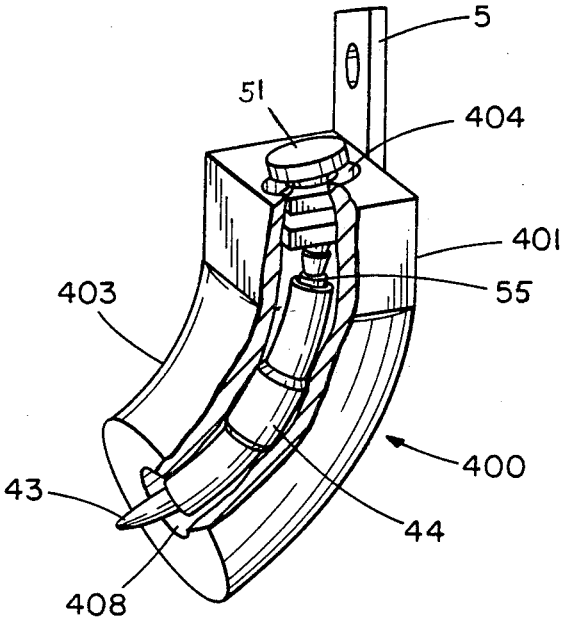
FIG. 32 is a perspective view of a seal mechanism enclosed by a covering.
Figure 33:
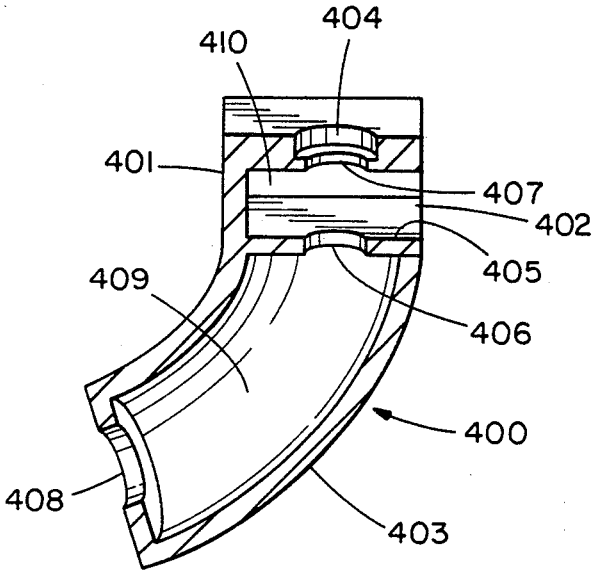
FIG. 33 is a cross-sectional view of the cover of FIG. 32.

Advantageously, further safeguarding of the integrity of the seal mechanism is made possible by an encapsulating hood or cover 400. The hood 400 known in FIGS. 32 and 33 comprises an upper rectangular portion 401 and a lower curved cylindrical portion 403. The curved cylindrical portion 403 is continuous with the upper rectangular portion 401 and gradually progresses from a rectangular at its upper extremity to a cylinder at its lower extremity. The back side of the upper rectangular portion 401 is provided with an opening 402. This back wall opening 402 in the upper rectangular portion 401 allows the hood 400 to easily be slipped over the brackets 5 and 6 of the doors of the maritime shipping container.

The upper rectangular portion 401 is provided in its upper surface or top wall with a cylindrical recess 404. Cylindrical recess 404 is of slightly greater diameter than the cylindrical enlargement 51 of the male member 43. The cylindrical recess 404 will accept the cylindrical enlargement 51 of the male member 43 and the cylindrical recess 404 is of greater depth than the depth of the cylindrical engagement 51. This will allow the cylindrical enlargement 51, in the assembled seal mechanism within the hood 400, to lie in the recess 404 and be at least flush with the upper surface of the rectangular portion 401.

The floor 405 of the upper rectangular portion 401, which may be characterized as an intermediate wall, contains a cylindrical hole 406. The top wall of the upper rectangular portion 401, below the cylindrical recess 404 and continuous with the cylindrical recess 404, contains a cylindrical hole 407. The holes 406 and 407 are slightly larger than the holes in the brackets 5 and 6 of the doors of the maritime shipping container.

The curved cylindrical portion 403, in its lower surface, has a cylindrical hole 408. The cylindrical hole 408 is slightly larger in diameter than the greatest diameter of the female receptacle 44. The curved cylindrical portion 403 thus contains a curved cylindrical cavity or space 409 which has a central radius of approximately 3.125 inches. The cavity 409 is entirely enclosed except for the holes 407 and 408.

The hood 400 can be made of metal by means of diecasting. It can also be made by means of metal stamping in two parts which can then be welded together.

In use, the hood 400 is positioned over the shipping container seal as follows:

The hood 400 is placed over the brackets 5 and 6 of the maritime shipping container so that the parallel parts 5*a* and 6*a* of the brackets (FIG. 1) lie within the space 410 of the upper rectangular portion 401. This is possible because of the back wall opening 402 in the upper rectangular portion 401.

The bullet-nosed tip of the male member 43 is then propelled through the cylindrical recessed space 404, the hole 407, the holes in the parallel parts 5*a* and 6*a* of the brackets, the hole 406 and the hole 408. The cylindrical enlargement 51 is recessed in the cylindrical recessed space 404. The bullet-nosed tip of the male member 43 protrude slightly beyond the opening of the hole 408.

The female receptacle 44 is manually pushed over the male member 43 and into the space 409 until the female receptacle can no longer be propelled over the male member 43. The female receptacle lies totally enclosed in the space 409 and up against the floor 405 of the upper rectangular portion 401 of the hood 400. This action will prevent the cylindrical enlargement 51 of the male member 43 from being dislodged upward and out of the cylindrical recess 404.

One desirable advantage of the hood or cover 400 is that the cylindrical enlargement 51 of the male member 43 lies permanently within the cylindrical recess 404. The cylindrical enlargement 51 is thus inaccessible to tampering or efforts to break it. Another advantage is that the female receptacle 44 which contains the locking mechanism of the shipping container seal lies totally enclosed under an additional cover because of its position in the curved cylindrical space 409. This further protects the seal from tampering and attempts to remove it.

Further, the male member 43 and the female receptacle 44, in the assembly process, have virtually closed the hole 408 to access by tampering. Lastly, when applied properly, the seal enclosed in the hood 400 should require a cutting torch to remove it.

Figure 34:
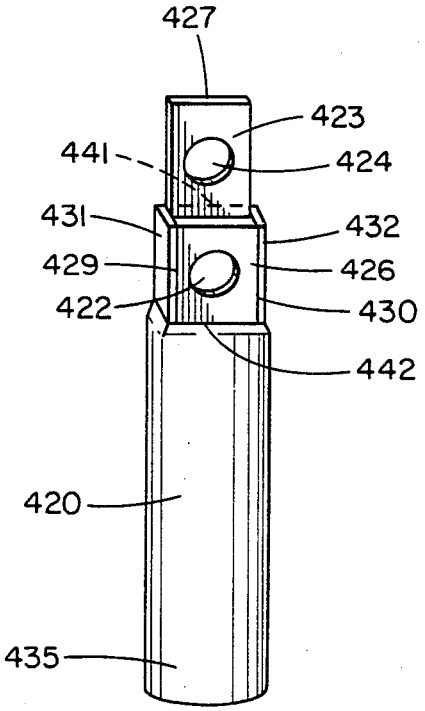
FIG. 34 is a perspective view of a modified cover during fabrication thereof.
Figure 35:
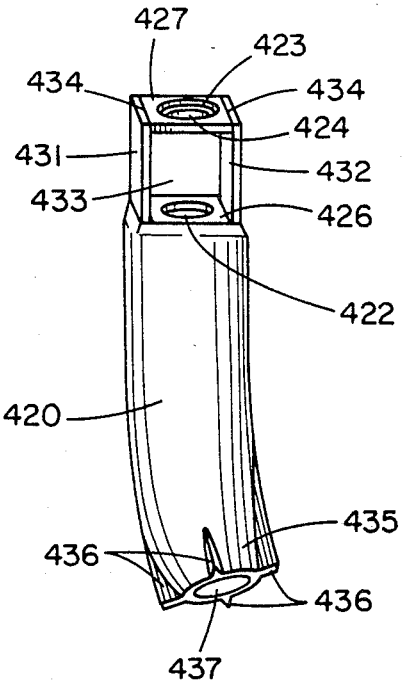
FIG. 35 is a perspective view of the completed cover of FIG. 34.

One relatively inexpensive method for making the hood 400 is shown in FIGS. 34 and 35.

The basic material is a cylindrical steel tube 420 having a suitable wall thickness. The configuration of the hood 400 from the cylindrical steel tube 420 is shown in FIGS. 34 and 35.

Basically, one end of the cylindrical steel tube 420 is placed in a die and compressed so as to form a rectangular portion 421. A cylindrical hole 422 is punched in the front wall 426 of the rectangular portion 421. The hole 422 has a diameter of at least 0.500 inch which is equal to the size of the holes in the brackets 5 and 6 of the doors of the maritime shipping container. A cylindrical recess 423 is formed in the back wall 427 of the rectangular portion 421. A cylindrical hole 424 of equal diameter to the cylindrical hole 422 is punched in the center of cylindrical recess 423. The rectangular portion 421 has a square opening 425. Metal is removed leaving a portion of the back wall 427 as shown in FIG. 34. Two slits 429 and 430 are cut in a wall of rectangular portion 421. Front wall 426 is bent backward 90 degrees along the line 422 as shown in FIG. 34. Back wall 427 is bent forward 90 degrees along line 441 as shown in FIG. 34.

A five-sided cube is formed as shown in FIG. 35. The five-sided cube has a back wall 433, two side walls 431 and 432, a roof 427 and a floor 426. The roof 427 has a cylindrical recess 423 and a cylindrical hole 424 in the center of that cylindrical recess 423. The floor 426 has a cylindrical hole 422 equal in diameter to the hole 424 in the roof. The spaces 434, along the sides of the roof 427, do not need to be welded because the assembled male member 43 and the female receptacle 44 will prohibit upward bending of the roof 427 after the seal has been assembled. Likewise, the spaces along the three sides of the floor 426 do not need to be welded because the assembled seal will prohibit bending of the floor 426 after this seal has been assembled.

The lower portion of the cylindrical steel tube 420 is now placed in a die and bent so as to have a central radius of 3.125 inches. The opposite end 435 of the cylindrical steel tube 420 is now placed into a die and compressed so as to deform the metal of the end 435 in the manner shown in FIG. 35. The purpose of this action is to produce an opening 437 which will have an inside diameter slightly larger than the largest outside diameter of the female receptacle 44. In the process of deforming the metal, four ear-like projections 436 are produced in the end 435 of the cylindrical steel tube 420. After the hood or cover 400 has been formed as shown in FIG. 35, it is case-hardened. The purpose of the case-hardening of the hood 400 is to frustrate sawing or other mechanical cutting processes.

There has been provided by the present invention a container seal which is very strong. The container seal of the present invention can be assembled by the use of the hands and without any special tools. Because of the sequential multiple cone shaped segments 52 on the male member 43, the container seal is adaptable to the requirements of the specific door brackets of maritime shipping containers, as well as to alleviate possible alignment problems with the holes in the door brackets. A hood can be applied to the container seal in a novel manner to further safeguard the integrity of the seal.

The seal components can be made and sold relatively inexpensively.

While I have shown and described presently preferred embodiments of the present invention, it will be apparent that the invention may be otherwise embodied within the scope of the appended claims.

I claim:

1. A shipping container seal for joining two members having holes therein comprising a male member adapted to pass through said holes in one direction and having an enlargement at one end to preclude the male member from slipping entirely through said holes, said male member being formed from a plurality of truncated conical segments, and a female member cooperating with said male member to prevent retrograde motion once said male member and said female member are assembled, said female member having locking means cooperating with said truncated conical segments to permit the male member to pass through the female member in one direction, but precluding retrograde motion said female member comprising half-barrel shaped inserts, and spring means for retaining the half barrel shaped inserts in assembled relationship, said spring means comprising a clip generally tubular in cross section and including sides spaced apart at one end and having inwardly deflected projections which cooperate with the exterior surface of the half-barrel shaped inserts and said sides being interconnected at the other end by a bridge.

2. A shipping container seal as in claim 1 wherein the female member has a tapered chamber therein, and the spring means are compressed by the walls of the tapered chamber during retrograde motion to ensure the continued entrapment of the male member within the female member.

3. A shipping container as in claim 1 including a hood comprising a tubular housing for enclosing the male member and the female member so as to prevent access thereto after the hood is assembled to safeguard the integrity of the seal.

4. A shipping container seal as in claim 3 wherein said tubular housing has a top wall, an intermediate wall and a bottom wall and each wall has an opening there through, and the rear of the tubular housing has an opening in the rear thereof between the upper wall and the intermediate wall adapted to receive brackets of the shipping container.

* * * * *